US005850073A

United States Patent [19]

Eckert

[11] Patent Number: 5,850,073

[45] Date of Patent: Dec. 15, 1998

[54] ELECTRIC HEATING ELEMENT AND HEATER ASSEMBLY

[76] Inventor: C. Edward Eckert, 260 Lynn Ann Dr., New Kensington, Pa. 15068

[21] Appl. No.: 937,364

[22] Filed: Sep. 25, 1997

Related U.S. Application Data

[63] Continuation-in-part of Ser. No. 882,922, Jun. 26, 1997, which is a continuation-in-part of Ser. No. 801,769, Feb. 18, 1997.

[51] Int. Cl.[6] ..... H05B 3/06

[52] U.S. Cl. ..... 219/523; 219/553; 219/544; 392/503; 392/447; 338/218; 373/117; 373/127

[58] Field of Search ..... 219/553, 552, 219/544, 540, 523, 548; 392/497, 503; 338/230, 218, 243; 266/252; 373/117, 127

[56] References Cited

U.S. PATENT DOCUMENTS

| | | | |
|---|---|---|---|
| 4,057,433 | 11/1977 | Brown | 106/38.3 |
| 5,616,263 | 4/1997 | Hyllberg | 219/543 |
| 5,665,262 | 9/1997 | Hajaligol | 219/553 |
| 5,692,291 | 12/1997 | Deevi | 338/319 |
| 5,738,819 | 4/1998 | Feagin | 264/365 |

*Primary Examiner*—Teresa J. Walberg
*Assistant Examiner*—Quan Nguyen
*Attorney, Agent, or Firm*—Andrew Alexander

[57] ABSTRACT

Disclosed is an improved electric heater assembly suitable for heating molten metal, the electric heater assembly having a sleeve comprised of a closed end suitable for immersing in the molten metal. The sleeve is fabricated from a composite material comprised of titanium alloy and having an outside surface to be exposed to the molten metal coated with a refractory resistant to attack by the molten metal; and an electric heater located in the sleeve in heat transfer relationship therewith.

29 Claims, 2 Drawing Sheets

ELECTRIC HEATING ELEMENT AND HEATER ASSEMBLY

CROSS REFERENCE TO RELATED APPLICATIONS

This application is a continuation-in-pait of U.S. Ser. No. 882,922, Filed Jun. 26, 1997, which is a continuation-in-pait of U.S. Ser. No. 08/801,769, filed Feb. 18, 1997, which is incorporated herein by reference.

BACKGROUND OF THE INVENTION

This invention relates to electric heaters, and more particularly, it relates to electric heating elements and heaters suitable for use in molten metals such as molten aluminum, for example.

In the prior art electric heaters used for molten aluminum are usually enclosed in ceramic tubes. Such electric heaters are very expensive and are very inefficient in transferring heat to the melt because of the air gap between the heater and the tube. Also, such electric heaters have very low thermal conductivity values that are characteristic of ceramic materials. In addition, the ceramic tube is fragile and subject to cracking. Further, heaters are limited by the ability of the heating element to withstand heat. Thus, there is a great need for an improved electric heater suitable for use with molten metal, e.g., molten aluminum, which has an improved heating element and which is efficient in transferring heat to the melt. The present invention provides such an electric heater.

SUMMARY OF THE INVENTION

It is an object of the invention to provide an improved electric heater assembly.

It is another object of the invention to provide an improved heating element for an electric heater.

It is still another object of the invention to provide an improved electric heater assembly for use in molten metal such as molten aluminum.

Yet, another object of this invention is to provide an improved electric heater assembly for use in molten metal, the electric heater assembly having a protective sleeve that has contact with the heating element utilizing a contact medium, thereby substantially eliminating the air gap between the heater and sleeve.

And yet, another object of the invention is to provide an improved electric heater assembly for use in molten metal, the electric heater assembly having a protective sleeve having a thermal expansion coefficient of less than $15\times10^{-6}$ in/in/° F.

And yet, it is a further object of the invention to provide an improved electric heater assembly for use in molten metal, the electric heater assembly having a protective sleeve comprised of a metal and layer of a material resistant to erosion or dissolution by molten metal such as molten aluminum, the heater assembly having an electric heating element comprised of titanium which can have a layer of titanium oxide thereon.

These and other objects will become apparent from the specification, drawings and claims appended hereto.

In accordance with these objects, there is disclosed an improved electric heater assembly suitable for heating molten metal. The electric heater assembly is comprised of a sleeve suitable for heating molten metal, the sleeve fabricated from a composite material comprised of metal or metal alloy and having an outside surface to be exposed to the molten metal coated with a refractory resistant to attack by the molten metal. An electric heating element is located in the sleeve in heat transfer relationship therewith for adding heat to the molten metal, the heating element comprised of titanium or titanium alloy which can have an oxide coating thereon. The coating can be comprised of titania.

DETAILED DESCRIPTION OF THE PREFERRED EMBODIMENTS

Figure 1:
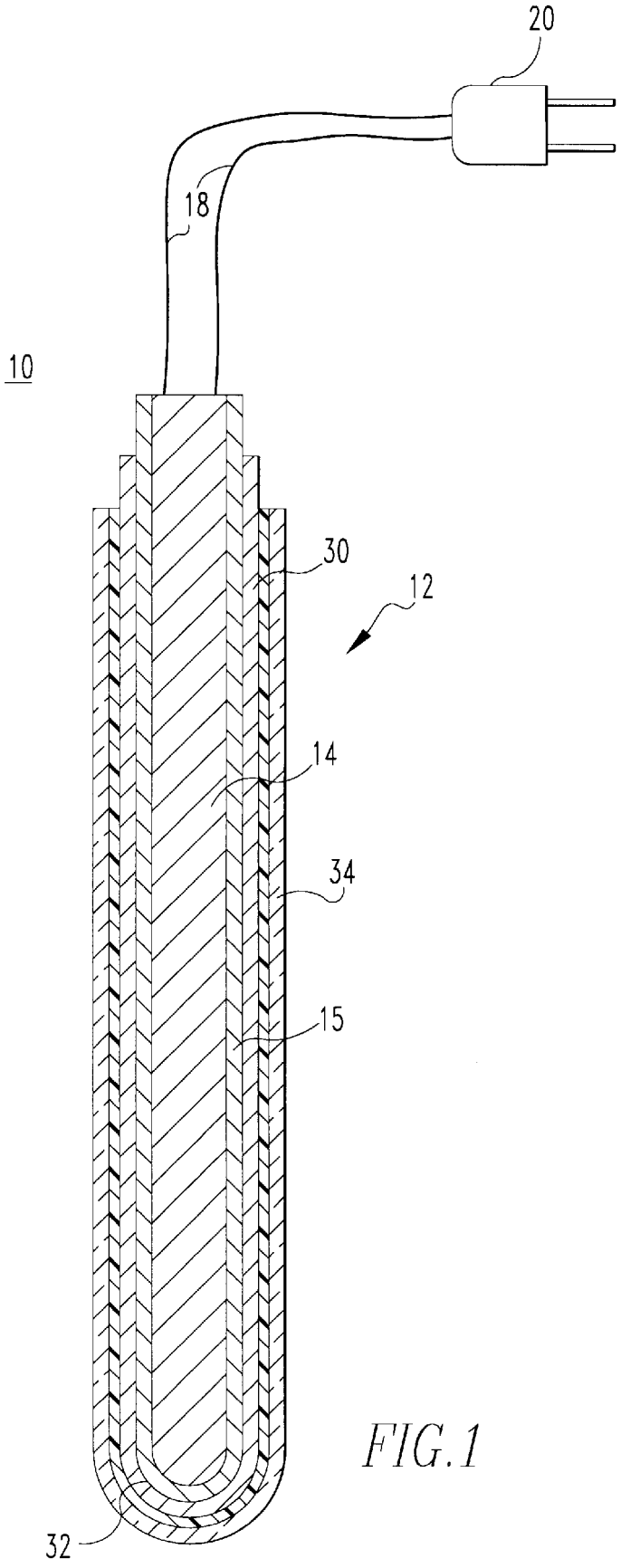
FIG. 1 is a cross-sectional view of an electric heater assembly in accordance with the invention.

Referring to FIG. 1, there is shown a schematic of an electric heater assembly 10 in accordance with the invention. The electric heater assembly is comprised of a protective sleeve 12 and an electric heating element 14. A lead 18 extends from electric heating element 14 and terminates in a plug 20 suitable for plugging into a power source. A suitable element 14 is available from International Heat Exchanger, Inc., Yorba Linda, CA 92687 under the designation P/N HTR2252.

Preferably, protective sleeve 12 is comprised of titanium tube 30 having an end 32 which preferably is closed. While the protective sleeve is illustrated as a tube, it will be appreciated that any configuration that protects or envelops electric heating element 14 may be employed. Thus, reference to tube herein is meant to include such configurations. A refractory coating 34 is employed which is resistant to attack by the environment in which the electric heater assembly is used. A bond coating may be employed between the refractory coating 34 and titanium tube 30. Electric heating element 14 is seated or secured in tube 30 by any convenient means. For example, swaglock nuts and fei-ules may be employed or the end of the tube may be crimped or swaged shut to provide a secure fit between the electric heating element and tube 30. In the invention, any of these methods of holding the electric heating element in tube 30 may be employed. It should be understood that tube 30 does not always have to be sealed. In one embodiment, electric heating element 14 is encapsulated in a metal tube 15, e.g., steel or Inconel tube, which is then inserted into tube 30 to provide an interference or friction fit. That is, it is preferred that electric heating element 14 has its outside surface in contact with the inside surface of tube 30 to promote heat transfer through tube 30 into the molten metal. Thus, air gaps between the surface of metal tube 15 of electric heating element 14 and inside surface of tube 30 should be minimized.

If electric heating element 14 is inserted in tube 30 with a friction fit, the fit gets tighter with heat because electric heating element 14 expands more than tube 30, particularly when tube 30 is formed from titanium.

While it is preferred to fabricate tube 30 out of a titanium base alloy, tube 10 may be fabricated from any metal or metalloid material suitable for contacting molten metal and which material is resistant to dissolution or erosion by the molten metal. Other materials that may be used to fabricate tube 30 include silicon, niobium, chromium, molybdenum, combinations of NiFe (364 NiFe) and NiTiC (40 Ni 60 TiC), particularly when such materials have low thermal expansion, all referred to herein as metals. Other metals suitable for tube 30 include: 400 series stainless steel including 410, 416 and 422 stainless steel; Greek ascoloy;

precipitation hardness stainless steels, e.g., 15-7 PH, 174-PH and AM350; Inconel; nickel based alloys, e.g., unitemp 1753; Kovar, Invar, Super Nivar, Elinvar, Fernico, Feichrome; metal having composition 30–68 wt. % Ni, 0.02–0.2 wt. % Si, 0.01–0.4 wt. % Mn, 48–60 wt. % Co, 9–10 wt. % Cr, the balance Fe. For protection purposes, it is preferred that the metal or metalloid be coated with a material such as a refractory resistant to attack by molten metal and suitable for use as a protective sleeve.

Further, the material or metal of construction for tube 30 may have a thermal conductivity of less than 30 BTU/ft hr ° F., and less than 15 BTU/ft hr ° F., with Another important feature of a desirable material for tube 30 is thermal expansion. Thus, a suitable material should have a thermal expansion coefficient of less than $15\times10^{-6}$ in/° F., with a preferred thermal expansion coefficient being less than $10–10^{-6}$ in/in/° F., and the most preferred being less than 7.5×10–6 in/in/° F. and typically less than $5–10^{-6}$ in/in/° F. The material or metal useful in the present invention can have a controlled chilling power. Chilling power is defined as the product of heat capacity, thermal conductivity and density. Thus, the metal in accordance with the invention may have a chilling power of less than 5000 $BTU^2/ft^4$ hr ° F., preferably less than 2000 $BTU^2/ft^4$ hr ° F, and typically in the range of 100 to 750 BTU /$ft^2$ hr ° F.

As noted, the preferred material for fabricating into tubes 30 is a titanium base material or alloy having a thermal conductivity of less than 30 BTU/ft hr ° F., preferably less than 15 BTU/ft hr° F., and typically less than 10 BTU/ft hr ° F., and having a thermal expansion coefficient less than $15\times10^{-6}$ in/in/° F., preferably less than $10\times10^{-6}$ in/in/° F., and typically less than $5–10^{-6}$ in/in/° F. The titanium material or alloy should have chilling power as noted, and for titanium, the chilling power can be less than 500, and preferably less than 400, and typically in the range of 100 to 300 BTU/$ft^2$ hr ° F.

When the electric heater assembly is being used in molten metal such as lead, for example, the titanium base alloy need not be coated to protect it from dissolution. For other metals, such as aluminum, copper, steel, zinc and magnesium, refractory-type coatings should be provided to protect against dissolution of the metal or metalloid tube by the molten metal.

For most molten metals, the titanium alloy that should be used is one that preferably meets the thermal conductivity requirements, the chilling power and, more importantly, the thermal expansion coefficient noted herein. Further, typically, the titanium alloy should have a yield strength of 30 ksi or greater at room temperature, preferably 70 ksi, and typical 100 ksi. The titanium alloys included herein and useful in the present invention include CP (commercial purity) grade titanium, or alpha and beta titanium alloys or near alpha titanium alloys, or alpha-beta titanium alloys. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.
(b) 8 Al, 1 Mo, 1 V, the remainder Ti and impurities.
(c) 6 Al, 2 Sn, 4 Zr, 2 Mo, the remainder Ti and impurities.
(d) 6 Al, 2 Nb, 1 Ta, 0.8 Mo, the remainder Ti and impurities.
(e) 2.25 Al, 11 Sn, 5 Zr, 1 Mo, the remainder Ti and impurities.
(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 Al, 4 V, the remainder Ti and impurities.
(b) 6 Al, 6 V, 2 Sn, the remainder Ti and impurities.
(c) 8 Mn, the remainder Ti and impurities.
(d) 7 Al, 4 Mo, the remainder Ti and impurities.
(e) 6 Al, 2 Sn, 4 Zr, 6 Mo, the remainder Ti and impurities.
(f) 5 Al, 2 Sn, 2 Zr, 4 Mo, 4 Cr, the remainder Ti and impurities.
(g) 6 Al, 2 Sn, 2 Zn, 2 Mo, 2 Cr, the remainder Ti and impurities.
(h) 10 V, 2 Fe, 3 Al, the remainder Ti and impurities.
(i) 3 Al, 2.5 V, the remainder Ti and impurities.

The beta titanium alloys comprise, by wt. %, 0 to 14 V, 0 to 12 Cr, 0 to 4 Al, 0 to 12 Mo, 0 to 6 Zr and 0 to 3 Fe, the remainder titanium and impurities.

Specific beta titanium alloys contain, by wt. %, about:

(a) 13 V, 11 Cr, 3 Al, the remainder Ti and impurities.
(b) 8 Mo, 8 V, 2 Fe, 3 Al, the remainder Ti and impurities.
(c) 3 Al, 8 V, 6 Cr, 4 Mo, 4 Zr, the remainder Ti and impurities.
(d) 11.5 Mo, 6 Zr, 4.5 Sn, the remainder Ti and impurities.

When it is necessary to provide a coating to protect tube 30 of metal or metalloid from dissolution or attack by molten metal, a refractory coating 34 is applied to the outside surface of tube 30. The coating should be applied above the level to which the electric heater assembly is immersed in the molten metal. The refractory coating can be any refractory material which provides the tube with a molten metal resistant coating. The refractory coating can vary, depending on the molten metal. Thus, a novel composite material is provided permitting use of metals or metalloids having the required thermal conductivity and thermal expansion for use with molten metal which heretofore was not deemed possible.

Because titanium or titanium alloy readily forms titanium oxide, it is important in the present invention to avoid or minimize the formation of titanium oxide on the surface of titanium tube 30 to be coated with a refractory layer. That is, if oxygen permeates the refractory coating, it can form titanium oxide and eventually cause spalling of the refractory coating and failure of the heater. To minimize or prevent oxygen reacting with the titanium, a layer of titanium nitride is formed on the titanium surface. The titanium nitride is substantially impermeable to oxygen and can be less than about 1 $\mu$m thick. The titanium nitride layer can be formed by reacting the titanium surface with a source of nitrogen, such as ammonia, to provide the titanium nitide layer.

When the electric heater assembly is to be used for heating molten metal such as aluminum, magnesium, zinc, or copper, etc., a refractory coating may comprise at least one of alumina, zirconia, yittria stabilized zirconia, magnesia, magnesium titanite, or mullite or a combination of alumina and titania having a coefficient of thermal expansion of less than $10\times10^{-6}$ in/in° F. While the refractory coating can be used on the metal or metalloid comprising the tube, a bond coating can be applied between the base metal and the refractory coating. The bond coating can provide for adjustments between the thermal expansion coefficient of the base metal alloy, e.g., titanium, and the refractory coating when necessary. The bond coating thus aids in minimizing cracking or spalling of the refractory coat when the tube is immersed in the molten metal or brought to operating temperature. When the electric heater assembly is cycled between molten metal temperature and room temperature, for example, the bond coat can be advantageous in preventing cracking, particularly if there is a considerable difference between the thermal expansion of the metal or metalloid and the refractory.

Typical bond coatings comprise Cr—Ni—Al alloys and Cr—Ni alloys, with or without precious metals. Bond coatings suitable in the present invention are available from Metco Inc., Cleveland, Ohio, under the designation 460 and 1465. In the present invention, the refiactory coating should have a thermal expansion that is plus or minus five times that of the base material. Thus, the ratio of the coefficient of expansion of the base material can range from 5:1 to 1:5, preferably 1:3 to 1:1.5. The bond coating aids in compensating for differences between the base material and the refractory coating.

The bond coating has a thickness of 0.1 to 5 mils with a typical thickness being about 0.5 mil. The bond coating can be applied by sputtering, plasma or flame spraying, chemical vapor deposition, spraying, dipping or mechanical bonding by rolling, for example.

After the bond coating has been applied, the refractory coating is applied. The refiractory coating may be applied by any technique that provides a uniform coating over the bond coating. The refractory coating can be applied by aerosol, sputtering, plasma or flame spraying, for example. Preferably, the refractory coating has a thickness in the range of 0.3 to 42 mils, preferably 5 to 15 mils, with a suitable thickness being about 10 mils. The refractory coating may be used without a bond coating.

In another aspect of the invention, boron nitide may be applied as a thin coating on top of the refractory coating. The boron nitride may be applied as a dry coating, or a dispersion of boron nitride and water may be formed and the dispersion applied as a spray. The boron nitride coating is not normally more than about 2 or 3 mils, and typically it is less than 2 mils.

The heater assembly of the invention can operate at watt densities of 25 to 250 watts/in$^2$ and typically 40 to 175 watts/in$^2$.

The heater assembly in accordance with the invention has the advantage of a metallic-composite sheath for strength and improved thermal conductivity. The strength is important because it provides resistance to mechanical abuse and permits an ultimate contact with the internal element. Intimate contact between heating element and sheath I.D. provides for substantial elimination of an annular air gap between heating element and sheath. In prior heaters, the annular air gap resulted in radiation heat transfer and also back radiation to the element from inside the sheath wall which limits maximum heat flux. By contrast, the heater of the invention employs an interference fit that results in essentially only conduction.

In conventional heaters, the heating element is not in intimate contact with the protection tube resulting in an annular air gas or space therebetween. Thus, the element is operated at a temperature independent of the tube. Heat from the element is not efficiently removed or extracted by the tube, greatly limiting the efficiency of the heaters. Thus, in conventional heaters, the element has to be operated below a certain fixed temperature to avoid overheating the element, greatly limiting the heat flux.

The heater assembly of the invention very efficiently extracts heat from the heating element and is capable of operating close to molten metal, e.g., aluminum temperature. The heater assembly is capable of operating at watt densities of 40 to 175 watts/in$^2$. The low coefficient of expansion of the composite sheath, which is lower than the heating element, provides for intimate contact of the heating element with the composite sheath.

Figure 2:
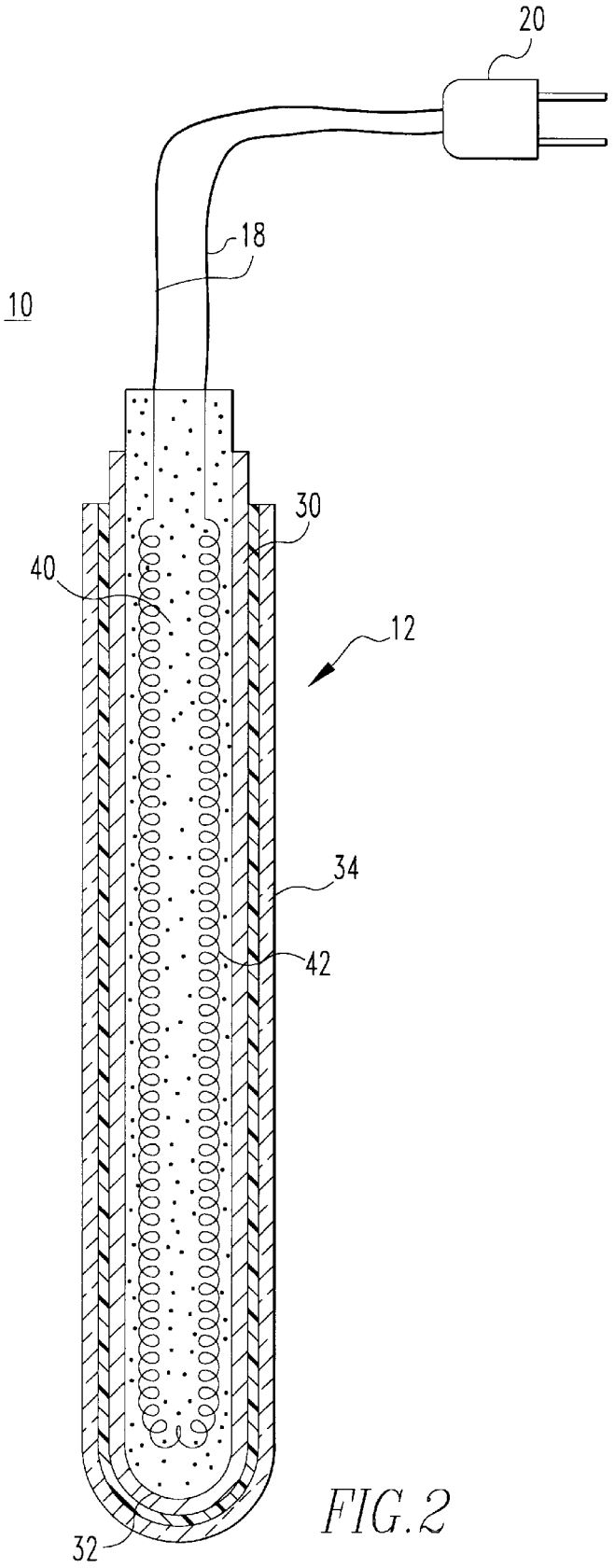
FIG. 2 is a cross-sectional view of an electric heater assembly showing a heating element and contact medium.

For better heat conduction from the heating element 42 (FIG. 2) to protective sleeve 12, a contact medium such as a low melting point, low vapor pressure metal alloy may be placed in the heating element receptacle in the baffle.

Alternatively, a powdered material 40 may be placed in the heating element receptacle. When the contact medium is a powdered material, it can be selected from silica carbide, magnesium oxide, carbon or graphite, for example. When a powdered material is used, the particle size should have a median particle size in the range from about 0.03 mm to about 0.3 mm or equivalent U.S. Standard sieve series. This range of particle size greatly improves the packing density of the powder and hence the heat transfer from electric element wire 42 (FIG. 2) to protective sleeve 12. For example, if mono-size material is used, this results in a one-third void fraction. The range of particle size reduces the void fraction below one-third significantly and improves heat transfer. Also, packing the range of particle size tightly improves heat transfer.

Heating elements that are suitable for use in the present invention are available from Watlow AOU, Anaheim, Calif. or International Heat Exchanger, Inc., Yorba Linda, Calif. These heating elements are often encased in Inconel tubes and use ICA or nicluome elements.

The low melting metal alloy can comprise lead-bismuth eutectic having the characteristic low melting point, low vapor pressure and low oxidation and good heat transfer characteristics. Magnesium or bismuth may also be used. The heater can be protected, if necessary, with a sheath of stainless steel; or a chromium plated surface can be used. After a molten metal contact medium is used, powdered carbon may be applied to the annular gap to minimize oxidation.

In another feature of the invention, a thermocouple (not shown) may be inserted between sleeve 12 and heating element 14 or heating element wire 42. The thermocouple may be used for purposes of control of the heating element to ensure against overheating of the element in the event that heat is not transferred away A sufficiently fast from the heating assembly. Further, the thermocouple can be used for sensing the temperature of the molten metal. That is, sleeve 12 may extend below or beyond the end of the heating element to provide a space and the sensing tip of the thermocouple can be located in the space.

In the present invention, it is important to use a heater control. That is, for efficiency purposes, it is important to operate heaters at highest watt density while not exceeding the maximum allowable element temperature, as noted earlier. The thermocouple placed in the heater senses the temperature of the heater element. The thermocouple can be connected to a controller such as a cascade logic controller to integrate the heater element temperature into the control loop. Such cascade logic controllers are available from Watlow Controls, Winona, Minn., designated Series 988.

Heating element wire or member 42 of the present invention is preferably comprised of titanium or a titanium alloy. The titanium or titanium alloy useful for heating element member 42 can be selected from the above list of titanium alloys. Titanium or titanium alloy is particularly suitable because of its high melting point which is 3137° F. for high purity titanium. That is, a titanium element can be operated at a higher heater inteinal temperature compared to conventional elements, e.g., nichrome which melts at 2650° F. Thus, a titanium based element 42 can provide higher watt densities without melting the element. Further, electrical characteristics for titanium remain more constant at higher temperatures. Titanium or titanium alloy forms a titanium oxide coating or titania layer (a coherent oxide layer) which protects the heating element wire. In a preferred embodiment of the present invention, an oxidant material is added or provided within the sleeve of the heater assembly to provide a source of oxygen for purposes of forming or repairing the coherent titanium oxide layer. The oxidant may be any material that forms or repairs the titanium oxide layer. The source of oxygen can include manganese oxide or potassium permanganate which may be added with the powdered contact medium.

The oxidant, such as manganese oxide or potassium permanganate, can be added to conventional heaters employing a powder contact medium to provide a source of oxygen for conventional heating wire such as ICA elements. This permits conventional heating elements to be sealed.

While the invention has been described in terms of preferred embodiments, the claims appended hereto are intended to encompass other embodiments which fall within the spirit of the invention.

What is claimed is:

1. An electric heater assembly for heating molten metal, the electric heater assembly comprised of:

(a) a sleeve suitable for immersing in said molten metal, the sleeve comprised of:

(i) a base metal layer having a coefficient of thermal expansion of less than $10\times10^{31\ 6}$ in/in/° F.;

(ii) an outside surface to be exposed to said molten metal coated with a refractory resistant to attack by said molten metal, the refractory having a coefficient of thermal expansion of less than $10\times10^{-6}$ in/in/° F.; and (iii) a bond coat located between said base metal layer and said refractory:

(b) an electric heating element located in said sleeve in heat transfer relationship therewith for adding heat to said molten metal, the electric heating element comprised of titanium or titanium alloy; and (c) a powdered contact medium in said sleeve for improved conduction of heat from said element to said sleeve.

2. The electric heater assembly in accordance with claim 1 wherein said metal layer is titanium or titanium alloy.

3. The electric heater assembly in accordance with claim 1 wherein the electric heating element is comprised of a titanium alloy selected from the group consisting of alpha, beta, near alpha, and alpha-beta titanium alloys.

4. The electric heater assembly in accordance with claim 1 wherein the electric heating element is comprised of a titanium alloy selected from the group consisting of 6242, 1100 and CP grade.

5. The electric heater assembly in accordance with claim 1 wherein the refractory coating is selected from the group consisting of one of $Al_2O_3$, $ZrO_2$, $Y_2O_3$ stabilized $ZrO_2$, and $Al_2\ O_3$—$TiO_2$.

6. The electric heater assembly in accordance with claim 2 wherein a bond coating having a thickness in the range of 0.1 to 5 mils is provided between said titanium alloy and said refractory.

7. The electric heater assembly in accordance with claim 1 wherein said refractory has a thickness in the range of 0.3 to 42 mils.

8. The electric heater assembly in accordance with claim 1 wherein said bond coating comprises an alloy selected from the group consisting of a Cr—Ni—Al alloy and a Cr—Ni alloy.

9. The electric heater assembly in accordance with claim 1 wherein the refractory comprises alumina.

10. The electric heater assembly in accordance with claim 1 wherein the refractory comprises zirconia.

11. The electric heater assembly in accordance with claim 1 wherein the refractory comprises yittria stabilized zirconia.

12. The electric heater assembly in accordance with claim 1 wherein the refractory comprises 5 to 20 wt. % titania and the balance alumina.

13. The electric heater assembly in accordance with claim 1 wherein said contact medium contains an oxidizing material to maintain a coherent oxide layer on said titanium.

14. The electric heater assembly in accordance with claim 1 wherein said contact medium is a powdered material selected from the group consisting of magnesium oxide, silicon carbide and carbon.

15. The electric heater assembly in accordance with claim 13 wherein said oxidizing material is selected from the group consisting of $MnO_2$ and $KMnO_3$.

16. The electric heater assembly in accordance with claim 1 wherein said contact medium is a powdered material having a median particle size in the range of 0.03 to 0.3 mm.

17. An electric heater assembly suitable for heating molten metal, the electric heater assembly comprised of a sleeve suitable for immersing in said molten metal, the sleeve fabricated from a composite material comprised of:

(a) a base metal layer having a coefficient of thermal expansion of less than $10\times10^{-6}$ in/in/° F.;

(b) a bond coat bonded to an outside surface of said base layer to coat said surface to be exposed to said molten metal;

(c) a refractory coating bonded to said bond coat, the refractory layer resistant to attack by said molten metal and having a coefficient of thermal expansion of less than $10\times10^{-6}$ in/in/° F.;

(d) an electric heating element located in said sleeve in heat transfer relationship therewith for adding heat to said molten metal, the electric heating element comprised of titanium or titanium alloy having the ability to form a coherent oxide of titanium therein; and (e) a powdered contact medium in said sleeve for improved conduction of heat from said element to said sleeve.

18. The electric heater assembly in accordance with claim 17 wherein said contact medium contains an oxidizing agent to provide said coherent oxide.

19. The electric heater assembly in accordance with claim 18 wherein the oxidizing agent is potassium permanganate.

20. An electric heater assembly suitable for heating molten metal, the electric heater assembly comprised of a sleeve having a closed end suitable for immersing in said molten metal, the sleeve fabricated from a composite material comprised of:

(a) a base metal layer of a titanium alloy selected from alpha, beta, near alpha, and alpha-beta titanium alloys;

(b) a bond coat bonded to an outside surface of said base layer to coat said surface to be exposed to said molten metal;

(c) a refractory layer bonded to said bond coat, the refractory layer resistant to attack by said molten metal; and (d) an electric heating element located in said sleeve in heat transfer relationship therewith for adding heat to said molten metal, said heating element comprised of titanium or titanium alloy.

21. The electric heater assembly in accordance with claim 20 wherein said titanium or titanium alloy is selected from 6242, Ti 1100 and CP grade titanium.

22. The electric heater assembly in accordance with claim 20 wherein said base metal layer has a coefficient of thermal expansion of less than $5\times10^{-6}$in/in/° F.

23. The electric heater assembly in accordance with claim 20 wherein said bond coat has a thickness in the range of 0.1 to 5 mils and said refractory layer has a thickness in the range of 0.3 to 42 mils.

24. The electric heater assembly in accordance with claim 20 wherein said refractory layer is selected from the group consisting of one of $Al_2O_3$, $ZrO_2$, $Y_2O_3$ stabilized $ZrO_2$, and $Al_2O_3$—$TiO_2$.

25. The electric heater assembly in accordance with claim 20 wherein said bond coat comprises an alloy selected from the group consisting of Cr—Ni—Al alloy and Cr—Ni–alloy.

26. The electric heater assembly in accordance with claim 20 wherein the ratio of coefficient of expansion of the refractory layer to the base metal layer is in the range of 5:1 to 1:5.

27. An electric heater assembly suitable for heating molten metal, the electric heater assembly comprised of a sleeve having a closed end suitable for immersing in said molten metal, the sleeve fabricated from a composite material comprised of:

(a) a base layer of a titanium or titanium alloy;

(b) a bond coat bonded to an outside surface of said sleeve;

(c) a refractory layer selected from a material comprising $Al_2O_3$, $ZrO_2$, $Y_2O_3$ stabilized $ZrO_2$, and $Al_2O_3$—$TiO_2$ bonded to said bond coat, the refractory layer resistant to attack by said molten metal;

(d) an electrical heating element located in said sleeve in heat transfer relationship therewith for adding heat to the molten metal, said heating element comprised of titanium or titanium having a layer of oxide on the surface thereof; and (e) a powdered contact medium in said sleeve to improve heat transfer from said heating element to said sleeve, the heater assembly capable of operating at a watt density in the range of 25 to 250 watts/in$^2$.

28. The electric heater assembly in accordance with claim 27 wherein the refractory layer $Al_2O_3$and said titanium alloy is selected from 6242, Ti 1100 and CP grade titanium.

29. The electric heater assembly in accordance with claim 27 wherein said base layer and said refractory layer each have a thermal coefficient of expansion of less than $5\times10^{-6}$in/in/° F.

* * * * *